US009579578B2

(12) United States Patent
Chasteen

(10) Patent No.: US 9,579,578 B2
(45) Date of Patent: Feb. 28, 2017

(54) ZIP LINE TROLLEY RETRIEVER SYSTEM

(71) Applicant: Ronald Chasteen, Washington, MO (US)

(72) Inventor: Ronald Chasteen, Washington, MO (US)

( * ) Notice: Subject to any disclaimer, the term of this patent is extended or adjusted under 35 U.S.C. 154(b) by 65 days.

(21) Appl. No.: 14/488,073

(22) Filed: Sep. 16, 2014

(65) Prior Publication Data

US 2016/0075343 A1 Mar. 17, 2016

(51) Int. Cl.
*A63G 21/22* (2006.01)

(52) U.S. Cl.
CPC ..... *A63G 21/22* (2013.01)

(58) Field of Classification Search
CPC ..... B61B 7/04; B61B 12/02; A63G 21/20; A63G 21/22; A63G 12/02; A63G 31/16
See application file for complete search history.

(56) References Cited

U.S. PATENT DOCUMENTS 7,966,941 B1 * 6/2011 Brannan ..... A63G 21/22 104/112
2011/0083577 A1 * 4/2011 Tilley ..... B61B 7/06 104/96
2011/0162917 A1 * 7/2011 Steele ..... A63G 21/22 188/65.2
2011/0259235 A1 * 10/2011 Blandon ..... B61B 12/06 104/112
2012/0042803 A1 * 2/2012 Beck ..... B61B 12/105 104/112
2012/0240812 A1 * 9/2012 Drogo ..... B61B 12/028 104/112
2013/0239841 A1 * 9/2013 Boren ..... B61B 7/06 104/112
2014/0158012 A1 * 6/2014 Hackett ..... F16D 63/008 104/113
2014/0311376 A1 * 10/2014 Brannan ..... B61H 9/02 104/113
2015/0013564 A1 * 1/2015 Trantina ..... B61B 12/02 104/112
2015/0059611 A1 * 3/2015 Brown ..... B61H 1/00 104/113
2015/0232105 A1 * 8/2015 Perry ..... B61B 12/028 105/149.1

* cited by examiner

*Primary Examiner* — Jason C Smith
(74) *Attorney, Agent, or Firm* — Hanes & Bartels LLC

(57) ABSTRACT

A cable riding transporter having one or more drive sheaves in rolling contact with the upper side of a suspended cable and including a motor operatively engaging at least one of the drive sheaves for propelling the retriever along the cable and including a control for operating the motor and its direction of rotation and mechanism to interconnect the transporter with a load, such as a zip line trolley.

10 Claims, 6 Drawing Sheets

ZIP LINE TROLLEY RETRIEVER SYSTEM

The present invention relates generally to transport apparatus and system that operates on a suspended cable. The present invention is particularly adapted for use on a recreational zip line to retrieve trolleys that have run to the lower end of the line.

BACKGROUND

A zip line basically consists of a trolley movably suspended on a cable that is erected over an inclined area. It is designed to enable a user to be propelled by gravity to travel from the top to the bottom of the inclined cable by holding on to, or attaching to, the freely moving trolley. Zip-lines come in many forms, most often used as a means of entertainment. They may be short and low, intended for child's play as found on some playgrounds. Longer and higher rides have become popular amusement rides and vacation activities. After the rider reaches the bottom end of the zip line cable the trolley must be returned to the top. The trolley return has been accomplished by several means. In simple low to the ground installations the return can be done by simply pushing the trolley back to the top of the cable on foot. The return has also been carried out with a line leading from the trolley to the uphill end of the line. In other installations the trolley is removed from the zip line and transported in some manor back to the top of the ride. Another method of return includes the passenger, as shown in U.S. Patent Application publication No. 2014/0182477.

The primary object of the present invention is to overcome the necessity for additional personnel, vehicles and time to carry out the cumbersome task of returning the zip line trolley to the higher elevation starting point.

A further object of the invention is to provide a simple transporter apparatus that can tow or push a cable suspended load carrier.

Other and further features and advantages of the present invention will be seen from an examination of the following specification, drawings and claims.

DESCRIPTION OF THE DRAWINGS

FIG. 3 FIG. 2 is a diagrammatic side view of the zip line of FIG. 1 where the batter powered retriever of the present invention has towed the trolley back to the higher station.

SUMMARY OF THE INVENTION

The transporter, or trolley retriever, of the present invention comprises a least one sheave that is in rolling contact with a supporting suspended cable. The at least one sheave is operatively interconnected to a battery powered motor which turns the at least one sheave and drives the retriever along the cable to either position the transporter on the cable or to tow another cable suspended apparatus.

DETAILED DESCRIPTION

Figure 1:
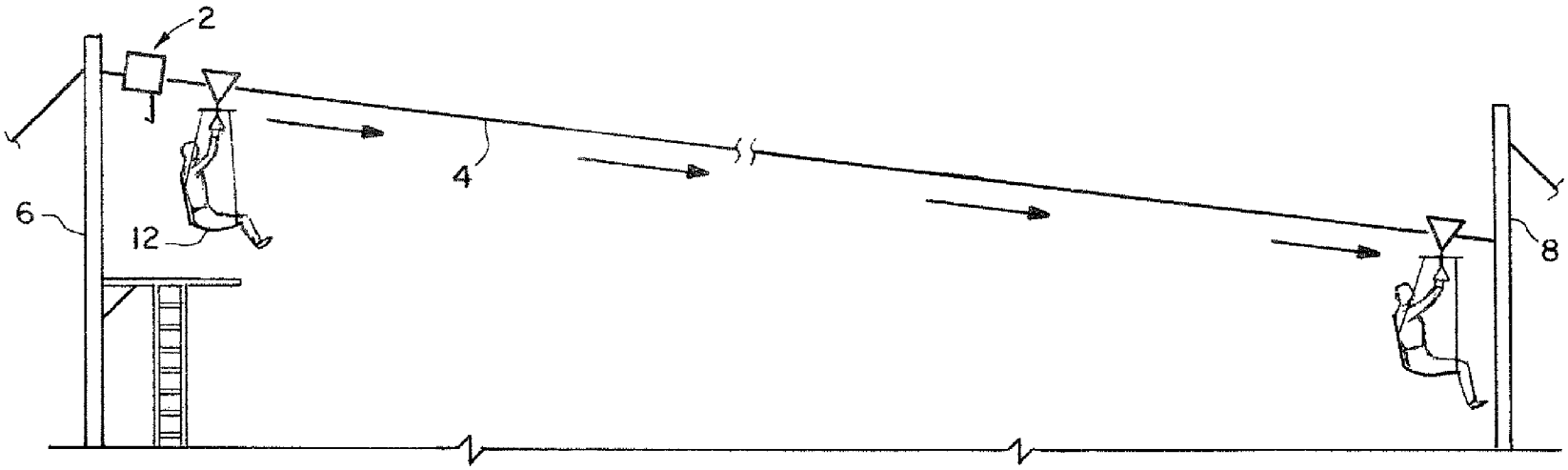
FIG. 1 is a diagrammatic side view of the zip line in which a rider is carried by a seat hanging from a cable engaging trolley from an upper station to a lower station.
Figure 2:
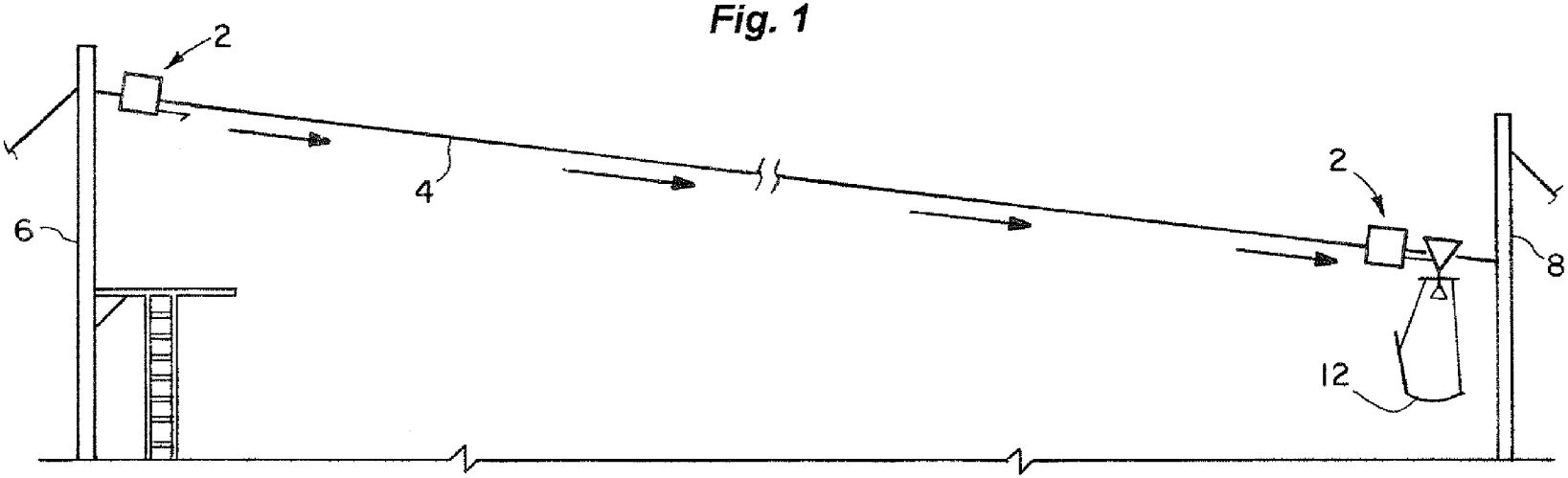
FIG. 2 is a diagrammatic side view of the zip line of FIG. 1 there the trolley retriever of the present invention follows the trolley to the lower station and attaches to the trolley.
Figure 3:
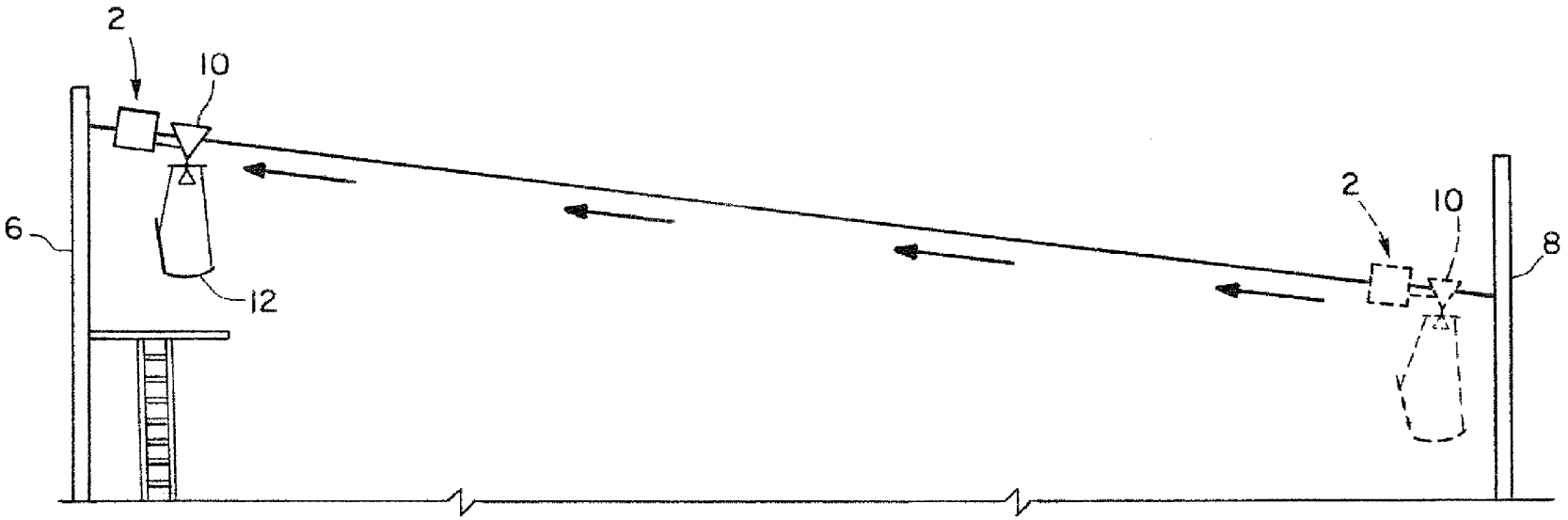
Figure 4:
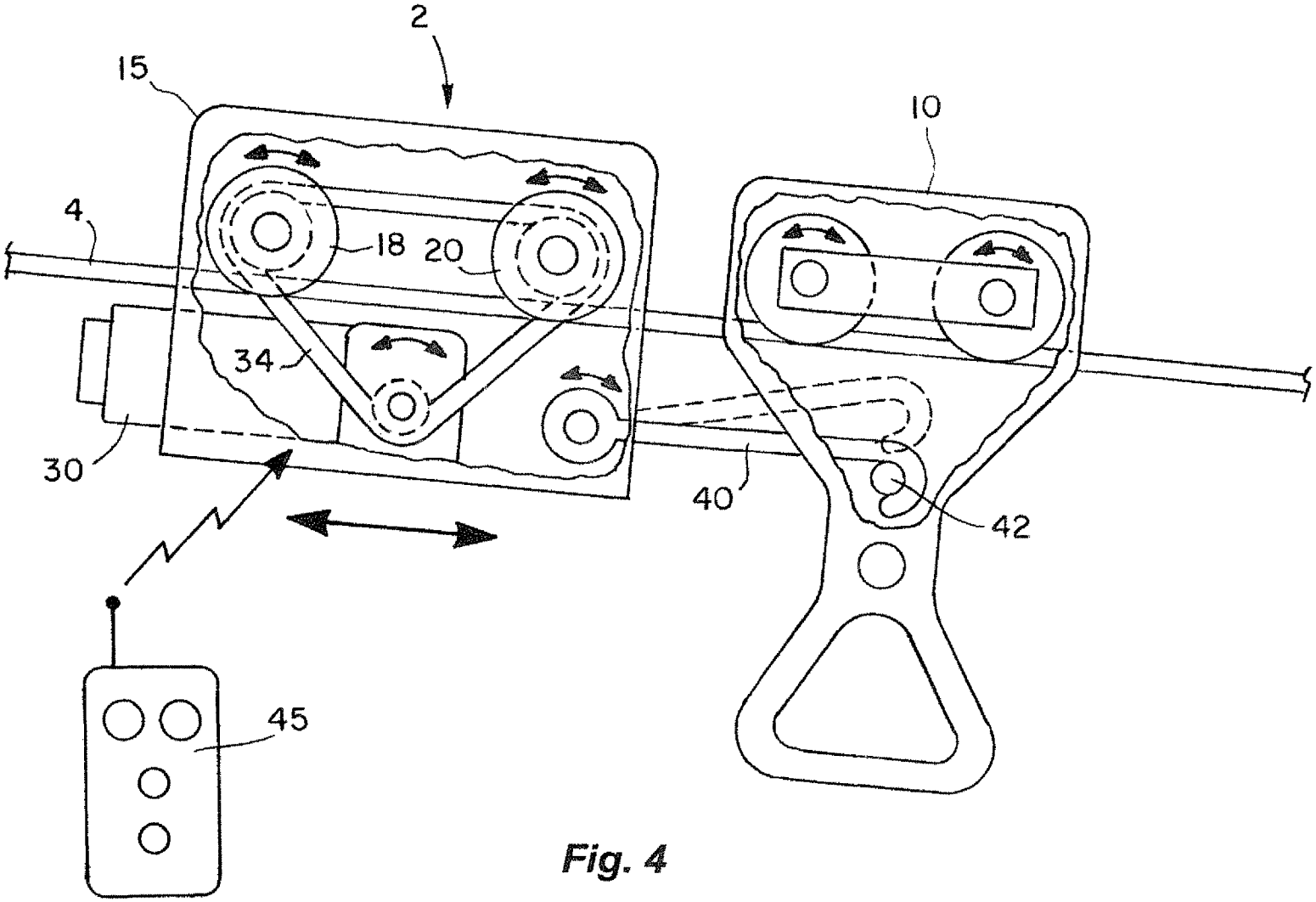
FIG. 4 is a fragmentary side view of the zip line trolley and the retriever of the present invention.
Figures 5, 6:
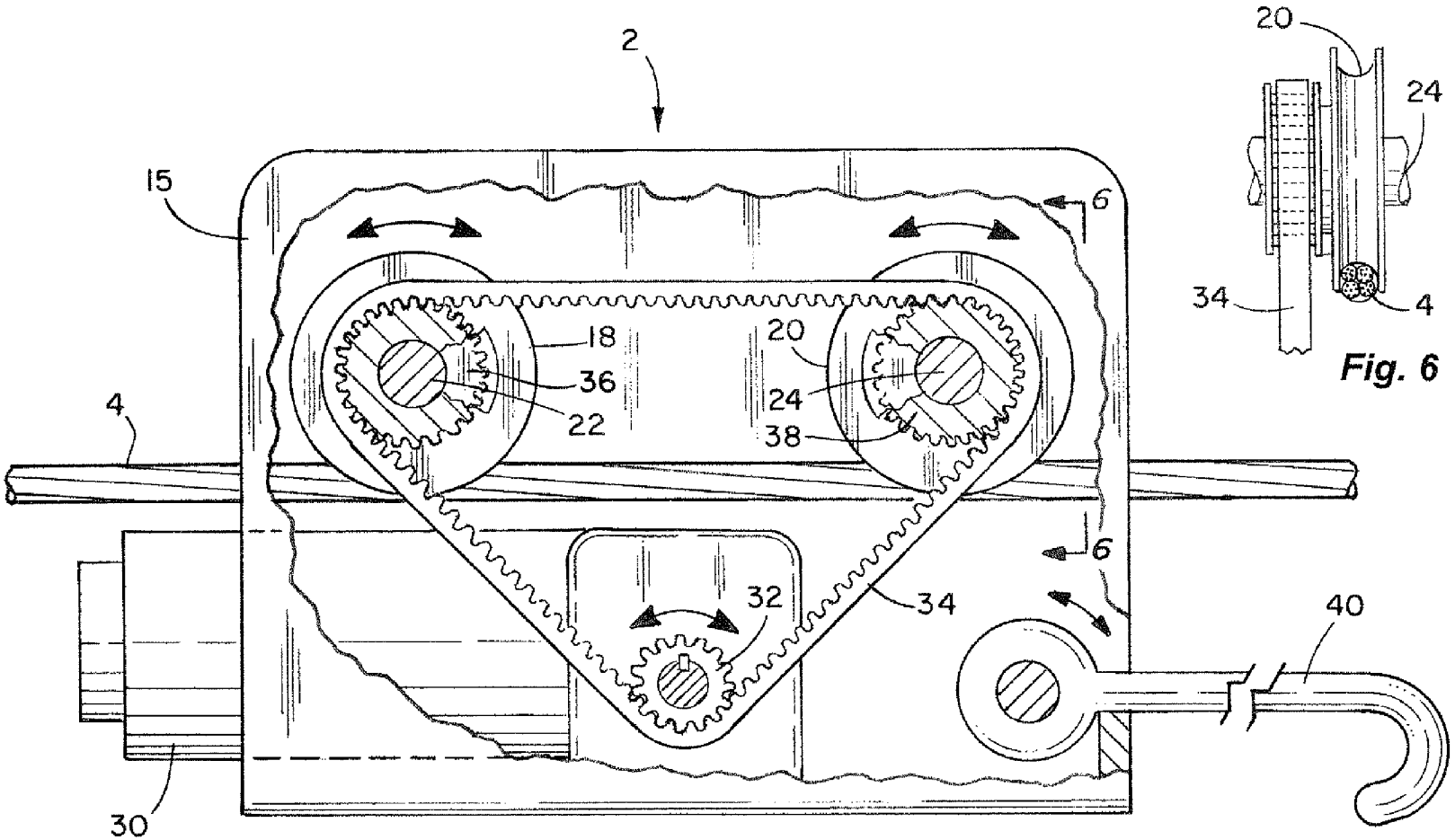
FIG. 5 is an enlarged fragmentary side view of the retriever of the present invention.
FIG. 6 is a cross sectional view taken along lines 6-6 of FIG. 5.

The transporter 2 of the present invention is diagrammatically shown in its role as a zip line trolley retriever in FIGS. 1-3. A zip line cable 4 is suspended between a high elevation support station 6 and a lower elevation support station 8. A rolling trolley 10, from which hangs a passenger support 12, is supported by the suspended cable 4. In a well known manner the passenger rides the trolley 10 and its attached platform 12 to the lower elevation station where the passenger disembarks from the platform, as shown in FIG. 1. When activated by a control mechanism, the retriever 2 is motor driven down the suspended cable 4 to a point proximate the trolley 10 where is connects to the trolley, as shown in FIG. 2. When activated by the control mechanism, the retriever, with the trolley in tow, is motor driven up the cable to the higher elevation station 6 where the trolley is disconnected and made ready for the next zip line decent, as shown in FIG. 3.

The retriever 2 comprises a body 15 that comprises side members that depend over each side of the zip line cable 4. Located in the interior of the retriever body 15, a pair of spaced apart sheaves 18 and 20 is disposed in rolling engagement with the upper side of the cable 4. The sheaves rotate on axles 22 and 24, which are attached at their respective ends to the depending sides of the body. A reversible DC motor 30 within the body 15 is provided with an output gear 32, which operates an endless loop drive belt 34 that engages gears 36 and 38 that are fixed to the respective sheaves 18 and 20 and which rotate on axles 22 and 24. Although a traditional drive belt is shown as the operative connection between the DC motor and the sheaves a gearing connection can also be used.

A hook 40 is carried by the body and is adapted to connect with a receiving pin 42 on the trolley.

The body 15 also carries a battery (not shown in the drawings) for powering the DC motor.

Preferably, the DC motor 30 is controlled by a traditional wireless controller 45 however; other known control options may be used.

Figure 7:
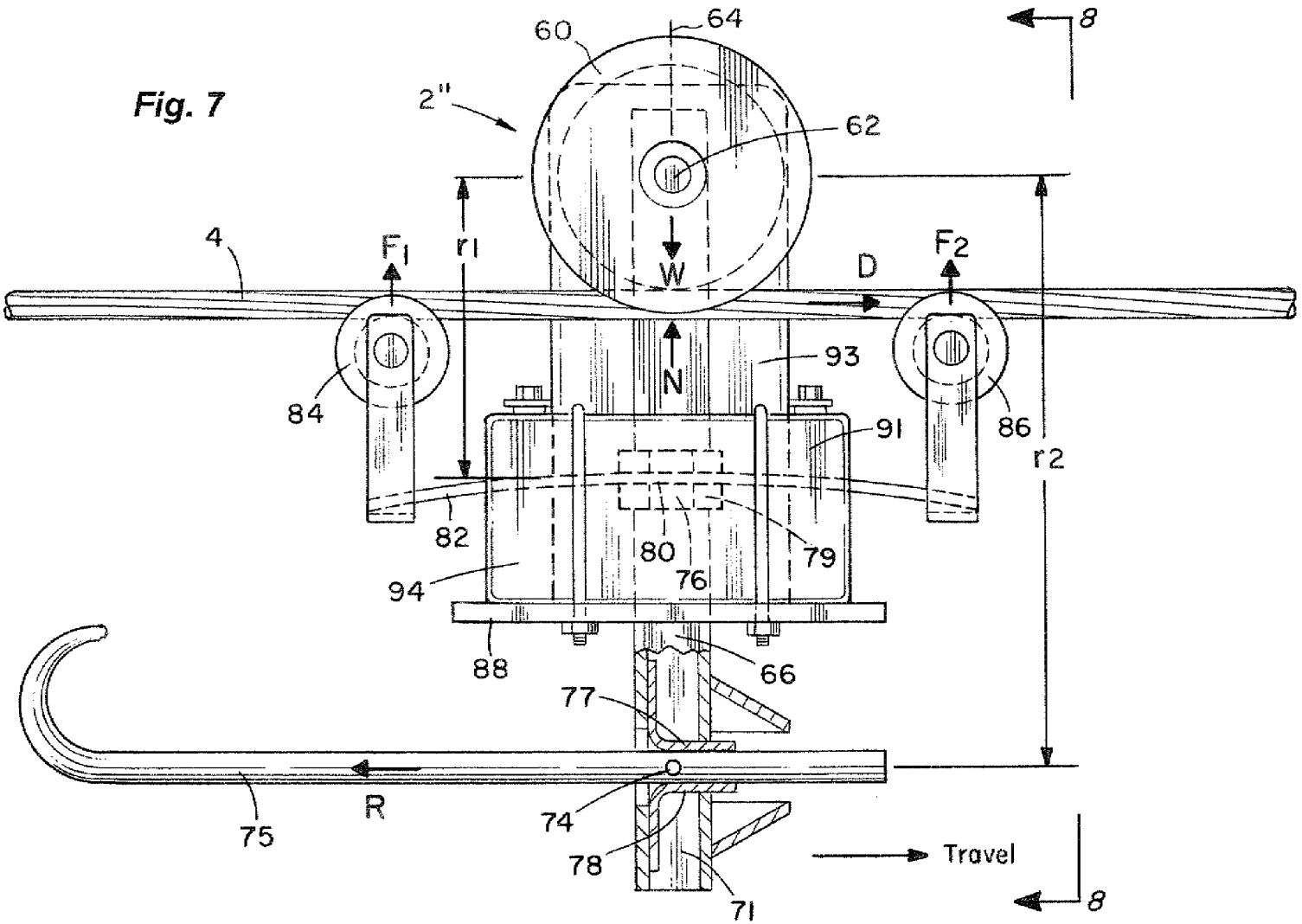
FIG. 7 is a side view of a second embodiment of the retriever where the retriever has a single sheave running on the supporting cable.
Figure 8:
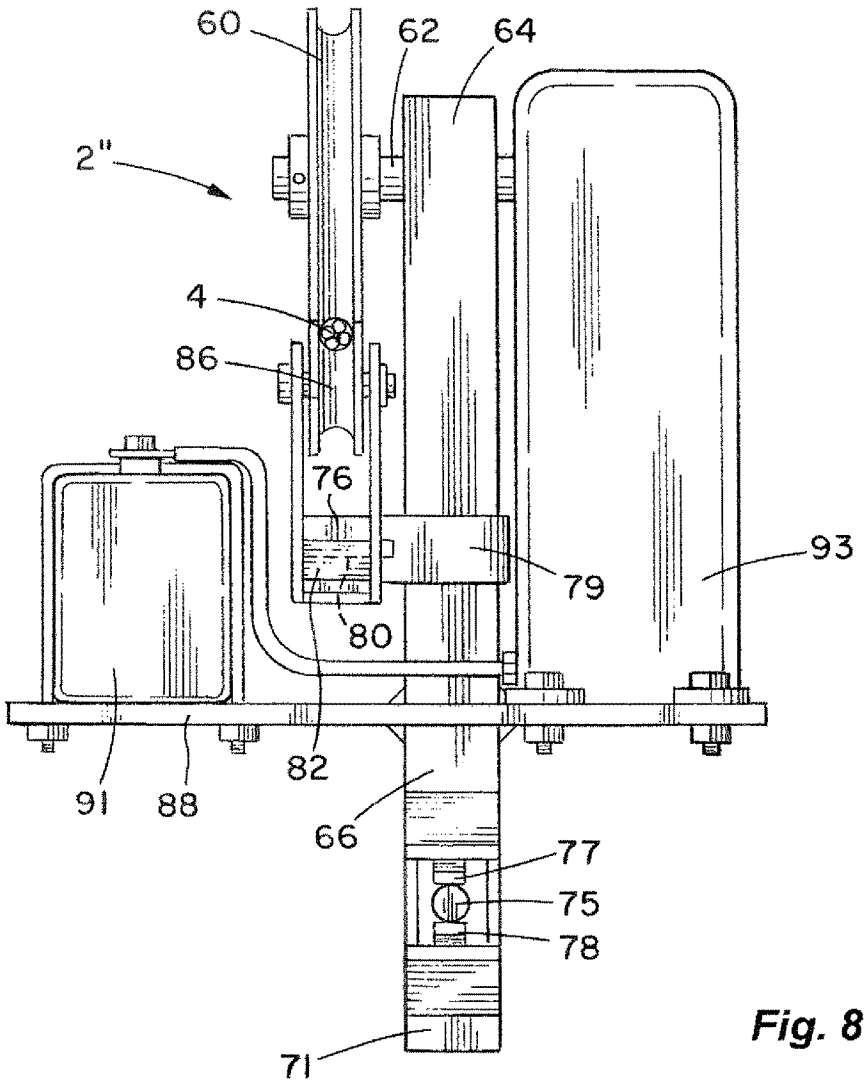
FIG. 8 is a cross sectional view of the second embodiment taken along lines 8-8 in FIG. 7.

As shown in FIG. 7, a second embodiment of the zip line retriever 2" comprises a single drive sheave 60 mounted in rolling engagement with the top side of the suspended cable 4. The sheave rotates on an axle 62. The distal end 64 of a depending lever 66 is pivotally attached to the sheave's axle 62. The proximal end 71 of the lever pivotally carries one end of an elongated hook 75, which is provided for connection to a load, such as a zip line trolley, that is to be towed by the retriever 2". The pivotal mounting of the hook allows it to be bumped by the load that will be towed by the retriever. The load's impact force on the hook causes it to pivot around point 74 to a position where the hook can engage a connecting loop on the load. Biasing springs 77 and 78 cause the hook to return to its center position once the hook is engaged with the load.

Beneath a mounting collar 79 and attached to the lever 66 is a laterally disposed floor 88 that carries a battery 91, a motor 93 and motor control apparatus 94. The traditionally geared output of the motor is operatively connected to the axle 62 for turning the sheave 60 and propelling the retriever 2". Although a geared motor is the preferred form of a drive system, a motor and drive belt combination could also be used.

Intermediate the distal and proximal ends of the lever 66 and below the suspended cable, a lateral extension 76 of a collar 79, that surrounds and is attached to the lever, provides a mounting platform 80 for the center of a flat cantilever spring 82 that extends laterally of the lever in a direction that is in alignment with and below the suspended cable 4. At the terminal ends of the cantilever spring there is mounted a pair of tensioner pulleys 84 and 86, the peripheral grooves of which engage the underside of the suspended cable 4 at a distance from the sheave 60.

The function of the tensioner pulleys is two-fold. First, assume that the retriever 2" is programmed to travel in direction 90 and tow a load with the hook 75, creating force R that tends to pivot the lever 66 clockwise around its axis 62. The force moment that is created is $R \times r_2$, the distance between the longitudinal center of the hook 75 and the center of rotation of the lever, the sheave axle 62. In order for the system to remain in equilibrium the sum of the force moments in the system must be zero, that is, the opposing force moments must be equal. That equilibrium is created be the force moment $F \times r_1$ where F is the force exerted by the tensioner pulley 84 against the cable 4 and $r_1$ is the distance between the spring mounting platform 80 and the center of the sheave axle 62.

The second function of the tensioner pulley is to increase the force of the drive sheave on the suspended cable 4 as the load force R increases, thus increasing the traction between the sheave and the cable. This reaction is seen by examining the forces present in the system as the force R increases. Statically, in summing the existing vertical forces, the weight of the system W is exerted against the suspended cable 4 through the drive sheave 60, which is in contact with the cable 4. The cable reacts with an opposing force N, supplemented by upward forces $F_1+F_2$, provided by the cantilever spring 82 through the tensioner pulleys 84 and 86. Thus, $W=N+F_1+F_2$. Dynamically, when the retriever is towing a load that creates a force R on the lever 66 reference can again be made to the sum of the moments equation, $F_1r_1=Rr_2$. Therefore, when R becomes a value or increases, $F_1$ increases since both of the r values remain constant. Accordingly, when $F_1$ increases, W also increases, since $W=N+F_1+F_2$, thus increasing the traction between the sheave 60 and the cable 4 and thereby increasing the driving force D.

I claim:

1. A zip line trolley retriever system comprising,
an elongated zip line having proximal and distal ends,
a first support attached to the proximal end of the zip line,
a second support disposed at lower elevation than that of the first support and attached to the distal end of the zip line,
a trolley movably supported on the zip line,
a trolley retriever having,
sheave means in rolling contact with upper surface of the zip line for supporting the retriever on the zip line,
reversible drive means operatively engaging the sheave means for propelling the retriever up and down the zip line.

2. The zip line trolley retriever system of claim 1 where the sheave means includes two sheaves.

3. The zip line trolley retriever system of claim 1 where the sheave means includes one sheave having an axle.

4. A zip line trolley retriever system comprising,
an elongated zip line having proximal and distal ends,
a first support attached to the proximal end of the zip line,
a second support disposed at lower elevation than that of the first support and attached to the distal end of the zip line,
a trolley movably supported on the zip line,
a trolley retriever having,
sheave means, including one sheave having an axle, in rolling contact with the upper surface of the zip line for supporting the retriever on the zip line,
reversible drive means operatively engaging the sheave means for propelling the retriever up and down the zip line,
a lever having distal and proximal ends where the distal end is pivotally mounted on the axle of the sheave,
first and second outrigger tensioner pulleys spaced apart from either side of the sheave and disposed in rolling contact with the underside of the zip line,
spring means interconnecting the lever and the idler pulleys, and
a load connector carried by the proximal end of the lever.

5. A transporter for pulling a load along a suspended cable, comprising,
at least one drive sheave in rolling contact with the upper side of the cable where the at least one drive sheave is a single drive sheave having an axle,
drive means operatively engaging the at least one sheave for propelling the transporter along the cable, including a motor,
motor control means for controlling the operation of the motor and its direction of rotation,
a lever having distal and proximal ends where the distal end is pivotally mounted on the axle of the sheave,
first and second outrigger tensioner pulleys spaced apart from either side of the sheave and disposed in rolling contact with the underside of the zip line,
spring means interconnecting the lever and the idler pulleys, and
a load connector carried by the proximal end of the lever.

6. A transporter for pulling a load along a suspended cable, comprising,
at least one drive sheave in rolling contact with the upper side of the cable where the at least one drive sheave is a single drive sheave having an axle,
drive means operatively engaging the at least one sheave for propelling the transporter along the cable, including a motor, and where the drive means includes a plurality of gears interconnecting the motor and the single drive sheave
motor control means for controlling the operation of the motor and its direction of rotation,
a lever having distal and proximal ends where the distal end is pivotally mounted on the axle of the sheave,
first and second outrigger tensioner pulleys spaced apart from either side of the sheave and disposed in rolling contact with the underside of the zip line,
spring means interconnecting the lever and the idler pulleys, and
a load connector carried by the proximal end of the lever, and
connector means attached to the lever for joining the transporter to a load to be towed along the cable.

7. A zip line trolley retriever system comprising,
an elongated zip line having proximal and distal ends,
a first support attached to the proximal end of the zip line, a second support disposed at lower elevation than that of the first support and attached to the distal end of the zip line, a trolley movably supported on the zip line, a trolley retriever having, sheave means in rolling contact with upper surface of the zip line for supporting the retriever on the zip line, reversible drive means operatively engaging the sheave means for propelling the retriever up and down the zip line where the reversible drive means comprises a direct current motor and further includes a source of electrical energy connected to the motor.

8. The zip line trolley retriever system of claim 7 and further including, motor control means for controlling the motor.

9. The zip line trolley retriever system of claim 8 where the motor control means includes a remote control.

10. A zip line trolley retriever system comprising, an inclined support cable, a gravity propelled trolley rollingly supported on the inclined cable, a trolley retriever having, at least one sheave disposed in rolling contact with the upper surface of the support cable, means for reversibly driving the at least one sheave for propelling the retriever up and down the inclined cable, and means for releasably interconnecting the trolley and the retriever.

* * * * *